US005648023A

United States Patent [19]

Nojima

[11] Patent Number: 5,648,023

[45] Date of Patent: Jul. 15, 1997

[54] VACUUM RESPONSE TYPE CARBURETOR

[75] Inventor: Tetsuo Nojima, Hamamatsu, Japan

[73] Assignee: Suzuki Kabushiki Kaisha, Japan

[21] Appl. No.: 693,622

[22] Filed: Aug. 8, 1996

Related U.S. Application Data

[63] Continuation of Ser. No. 346,409, Nov. 29, 1994, abandoned.

[30] Foreign Application Priority Data

Nov. 30, 1993 [JP] Japan ..... 5-300014

[51] Int. Cl.[6] ..... F02M 9/06

[52] U.S. Cl. ..... 261/44.4

[58] Field of Search ..... 261/44.4

[56] References Cited

U.S. PATENT DOCUMENTS

| | | | |
|---|---|---|---|
| 3,342,463 | 9/1967 | Date et al. | 261/44.4 |
| 3,460,814 | 8/1969 | O'Neill | 261/44.4 |
| 3,784,172 | 1/1974 | Sato et al. | 261/44.4 |
| 4,300,490 | 11/1981 | Hattori et al. | 261/44.4 |
| 4,323,521 | 4/1982 | Morgenroth | 261/50 |

FOREIGN PATENT DOCUMENTS

| | | | |
|---|---|---|---|
| 0165555 | 9/1983 | Japan | 261/44.4 |

OTHER PUBLICATIONS

Patent Abstracts of Japan, vol. 11, No. 388 (M–652) 18 Dec. 1987.

Patent Abstracts of Japan, vol. 13, No. 296 (M–846) 10 Jul. 1989.

*Primary Examiner*—Tim R. Miles

*Attorney, Agent, or Firm*—Adams & Wilks

[57] ABSTRACT

A motorcycle vacuum response type carburetor comprises a carburetor body having an upper portion, a lower portion, a diaphragm device disposed at the upper portion and a floating member disposed at the lower portion. The diaphragm device has a diaphragm chamber and a diaphragm comprised of hydrogen impregnated nitrile butadiene rubber separating the diaphragm chamber into an upper section and a lower section. A venturi passage extends horizontally through the carburetor body and a guide passage extends through the venturi passage. The guide passage has an upper end portion in communication with the lower section of the diaphragm chamber. A piston valve is movably disposed in the guide passage and has a head portion fixed to a central portion of the diaphragm. A needle valve for adjusting a jetting amount of a fuel is mounted to a lower portion of the piston valve and extends into the float chamber. A first communication passage communicates the lower section of the diaphragm chamber to the atmosphere. A second communication passage extends through the piston valve for communicating the upper section of the diaphragm chamber to the venturi passage. The second communicating passage has an opening at a lower end thereof which opens from a lower end portion of the piston valve and is in close proximity to the needle valve.

17 Claims, 3 Drawing Sheets

VACUUM RESPONSE TYPE CARBURETOR

This is a continuation of application Ser. No. 08/346,409 filed Nov. 29, 1994, now abandoned.

BACKGROUND OF THE INVENTION

The present invention relates to a vacuum response type carburetor provided with an improved diaphragm device.

A vacuum response type carburetor which is mainly used for a motorcycle has a structure in which a pressure change, within a venturi passage in the carburetor, caused by opening and closing of a throttle valve is transmitted to a diaphragm disposed in a diaphragm chamber device to thereby open or close a piston valve interlocked with the diaphragm.

That is, when a throttle grip of the motorcycle is operated, a butterfly-type throttle valve provided within the venturi passage opens or closes, and then, the pressure within the venturi passage is thereby raised or lowered. This pressure change is thereby transmitted to the diaphragm chamber device, and the diaphragm disposed in the diaphragm chamber device and made of a thin rubber film is moved, so that the piston valve which is interlocked with the diaphragm is also moved to thereby adjust the passage area of the venturi passage and the amount of fuel to be delivered. Consequently, an air-fuel mixture of an optimal air-fuel ratio according to the degree of opening of the throttle valve is always provided to the engine side, thus maintaining engine properties and fuel consumption to a desired condition.

Since the diaphragm of the carburetor is perpetually exposed to a mist of gasoline which is the fuel for the engine, the diaphragm is formed, in the prior art, of a rubber material having chemical-resistant property, such as hydrine rubber or NBR (nitrile butadiene rubber).

However, qualities of gasolines are different in various countries. In some cases, the quality of the gasoline is lesser than that in Japan and, accordingly, there is a possibility of gasoline having poor quality adhering to the diaphragm, thereby advancing the deterioration of the diaphragm.

For example, since hydrine rubber is apt to swell when contacting gasoline of poor quality, a diaphragm formed of hydrine rubber may become soft and deteriorate, leading to early rupturing. On the other hand, a diaphragm formed of NBR may become hard and deteriorate, thereby obstructing smooth sliding of a piston valve assembled in a carburetor.

A high-octane gasoline and an alcohol fuel have a tendency to cause the diaphragm to deteriorate as compared to a regular gasoline.

In view of the foregoing disadvantages, in the prior art, the diaphragm is formed thicker in order to slow the deterioration from the gasoline of poor quality, the high-octane gasoline and the alcohol fuel to prevent early rupturing and obstruction of smooth sliding of the piston valve. However, when the thickness of the diaphragm is increased, the rigidity of the diaphragm increases and the flexibility thereof decreases, so that the sliding friction of the piston valve increases. As a result, the piston valve cannot slide quickly and, consequently, the throttle response is made worse.

SUMMARY OF THE INVENTION

An object of the present invention is to substantially eliminate defects or drawbacks encountered in the prior art and to provide a vacuum response type carburetor capable of preventing deterioration of a diaphragm caused by a gasoline of poor quality, high-octane gasoline and alcohol fuel, etc. to maintain an improved throttle response.

Another object of the present invention is to provide a vacuum response type carburetor capable of protecting seal members such as gaskets, O-rings, etc. from deterioration caused by gasoline of poor quality, high-octane gasoline and alcohol fuel, etc.

These and other objects can be achieved according to the present invention by providing a vacuum response type carburetor which is provided with a diaphragm device including a diaphragm chamber separated into two chambers by means of a diaphragm and provided with a carburetor body including a venturi passage which is communicated with the diaphragm chamber and in which a throttle valve is disposed. A pressure change within the venturi passage caused by opening and closing the throttle valve is transmitted to the diaphragm device and the diaphragm is moved up and down, thereby opening and closing a piston valve interlocked with the diaphragm. The diaphragm is formed of hydrogen impregnated nitrile butadiene rubber (NBR).

Furthermore, seal members such as gasket and O-rings disposed in the carburetor to portions requiring a liquid-proof property are also formed of hydrogen impregnated NBR.

A fluoro rubber may be substituted for the hydrogen impregnated NBR.

According to the present invention of the characters described above, the hydrogen impregnated NBR has higher chemical-resistant properties than the conventionally used hydrine rubber or NBR, so that the usage of the NBR materials results in prevention of deterioration of the diaphragm caused by gasoline of poor quality, high-octane gasoline and alcohol fuel, etc., and effectively avoids early rupturing, hardening, etc. of the diaphragm.

Furthermore, since the tensile strength of the diaphragm greatly improves over that of the conventional diaphragms, the thickness of the diaphragm can be made thinner, thus improving the throttle response greatly.

The formation from seal members of the hydrogen impregnated NBR can prevent the deterioration of these seal members, thereby effectively preventing fuel leakage and improper settings of elements.

DETAILED DESCRIPTION OF THE PREFERRED EMBODIMENT

Figure 1:
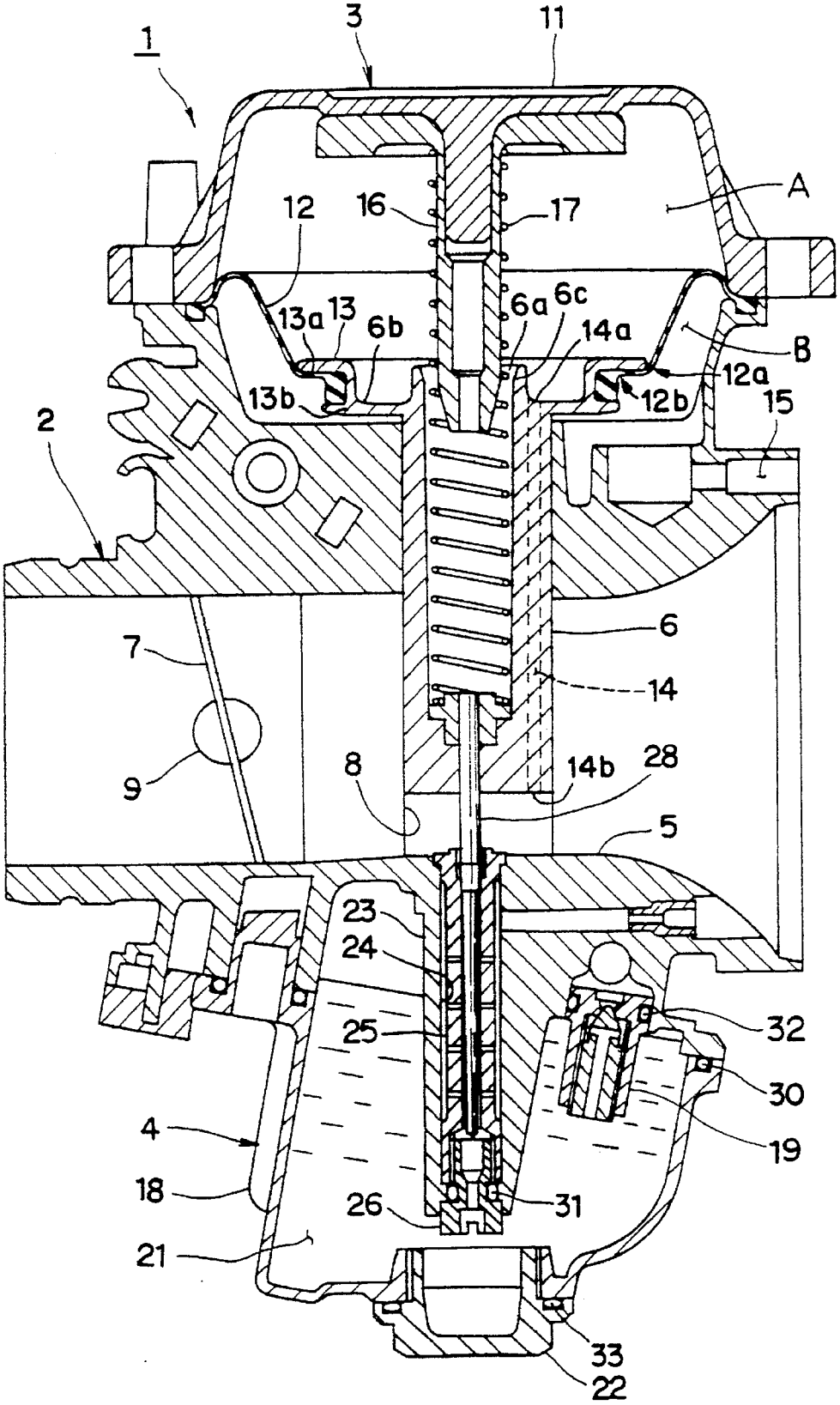
FIG. 1 is a vertical sectional view of a vacuum response type carburetor according to one embodiment of the present invention.

One preferred embodiment of the present invention will be described hereunder with reference to the accompanying drawings, in which FIG. 1 is a vertical sectional view of a vacuum response type carburetor 1 according to the present invention used for a motorcycle, for example, in which the right side as viewed is the air cleaner side and the left side is the engine side.

The vacuum response type carburetor 1 mainly comprises a carburetor main unit 2, which is provided with a diaphragm device 3 at the upper end thereof and with a float chamber 4 at the lower end thereof. The carburetor main unit 2 is formed with a venturi passage 5 passing through the entirety thereof in a horizontal direction. A piston valve 6 and a butterfly type throttle valve 7 are disposed within the venturi passage 5. The piston valve 6 has a bore 6*a* and moves freely vertically along a guide passage 8 which intersects with the venturi passage 5. On the other hand, the throttle valve 7 rotates freely around a supporting shaft 9.

The diaphragm device 3 is covered by a diaphragm cover 11 in a liquid-proof manner on the upper portion of the carburetor main unit 2, and the inner space defined thereby is separated by a diaphragm 12 into an upper chamber A and lower chamber B. The diaphragm 12 is formed of a rubber material such as hydrogen impregnated NBR or fluoro rubber.

The diaphragm 12 is formed so as to provide, for example, a doughnut-shape with the outer periphery thereof being nipped between the diaphragm cover 11 and the carburetor main unit 2, and with the inner periphery thereof being fitted into a flange 13 formed on the head portion of the piston valve 6. The head portion of the piston value 6 has a recess 6*b*. The flange 13 comprises flange portions 13*a*, 13*b* disposed around the recess 6*b*. The flange portion 13*a* has a greater diameter than the flange portion 13*b*. The inner periphery of the diaphragm 12 is fitted between the flange portions 13*a*, 13*b* in a liquid-tight manner. An upper end portion 6*c* of the piston valve 6 extends into the recessed portion 6*b*.

The upper chamber A of the diaphragm device 3 is connected to the venturi passage 5 by means of a communicating or connecting passage 14 formed in the piston valve 6. On the other hand, the lower chamber B is opened to the air cleaner side (atmosphere side) by means of a connecting passage 15 formed in the carburetor main unit 2. The connecting passage 14 has an opening 14*a* at an upper end thereof which opens into the upper chamber A, and an opening 14*b* at a lower end thereof which opens into the venturi passage 5.

A guide rod 16 is secured to the diaphragm cover 11, and a spring 17 which is pressed between the guide rod 16 and the piston valve 6 forces the piston valve 6 downwards. Consequently, the central potion of the diaphragm 12 is also forced downward. The inner volume of the upper chamber A is made greater than that of the lower chamber B.

The float chamber 4 is covered by a chamber casing 18 in a liquid-proof manner on the lower portion of the carburetor main unit 2, and a fuel 21 is provided from a nozzle 19 having a front end disposed in the float chamber 4. The fuel surface is maintained constant by means of a float device, not shown, and a drain bolt 22 is applied to the float chamber 4.

Figure 2:
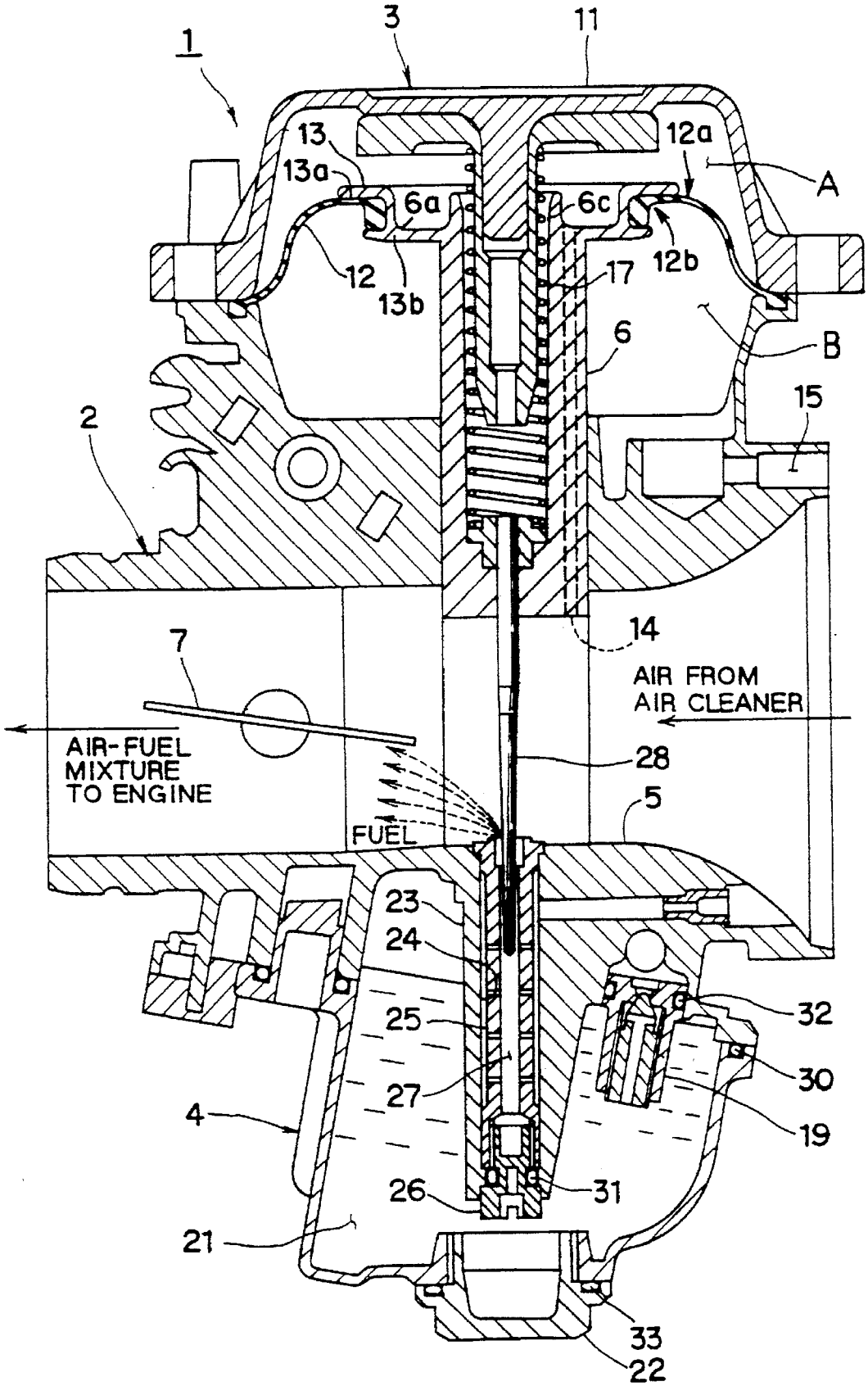
FIG. 2 is also a vertical sectional view of the vacuum response type carburetor of FIG. 1 with a piston valve ascended.

A boss 23 is formed integrally on the lower side of the carburetor main unit 2 so as to extend into the float chamber 4, and a suction passage 24 which communicates with the venturi passage 5 is formed within the boss 23. A needle jet 25 is inserted into the suction passage 23 from the upper side, as viewed, thereof and a main jet 26 is engaged with the lower end of the boss 23 so as to be screwed with the needle jet 25 from the lower side thereof. The needle jet 25 is formed with a central passage 27, as shown in FIG. 2, through which the fuel is sucked upward, and the lower portion of the central passage 27 is narrowed by the main jet 26 to thereby adjust the quantity of the fuel flow.

A needle valve 28 is fixedly mounted to the lower portion of the piston valve 6 and extends into the bore 6*a* thereof. The needle valve 28 has a tapered outer periphery so that the needle valve 28 moves axially with a circumferential space through the central passage 27 of the needle jet 25 in accordance with movement of the piston valve 6.

Seal members, such as a gasket 30 which seals the joint between the carburetor main unit 2 and the float chamber casing 18, an O-ring 31 provided between the needle jet 25 and the main Jet 26 and O-rings 32 and 33 provided on the nozzle 19 within the float chamber 4 and on the drain bolt 22, are or may be also formed of hydrogen impregnated NBR or fluoro rubber.

The throttle valve 7 is opened in accordance with the rotated degree of a throttle grip provided on the handlebar of a motorcycle, and the piston valve 6 opens according to the change in pressure within the venturi passage 5. That is, as shown in FIG. 1, in the case where the throttle valve 7 is in the opened state, the suction vacuum is not exerted upon the inside of the venturi passage 5, so that the piston valve 6 does not ascend and the passage area of the venturi passage 5 is minimal. At this time, the fuel 21 within the float chamber 4 is delivered to the downstream side of the throttle valve 7 through the pilot jet 25 and the engine is hence rotated at the idling rotation rate.

Then, as shown in FIG. 2, when the throttle valve 7 is opened, the suction vacuum from the engine is exerted upon the inside of the venturi passage 5. This vacuum condition is transmitted to the upper chamber A of the diaphragm device 3 by means of the connecting passage 14 provided within the piston valve 6. At this time, the atmospheric pressure from the connecting passage 15 is applied to the lower chamber B of the diaphragm device 3, thereby lifting the diaphragm 12 upward due to the difference in pressure of the vacuum being exerted to the upper chamber A and the atmospheric pressure being applied to the lower chamber B. Then, the piston valve 6 ascends under the interconnection with the diaphragm 12, and the passage area of the venturi passage 5 is expanded. The piston valve 6 is kept stationary by means of the force balance between the ascending force, which is caused by the pressure difference between the upper chamber A and the lower chamber B, and the pressing force of the spring 17. When the piston value 6 moves upward and downward in the guide passage 8, two bending circle lines 12*a* and 12*b* are produced alternately on the diaphragm 12. The diameter of the bending circle line 12*a* is greater than the diameter of the bending circle line 12*b*. By this construction, the bending durability of the diaphragm 12 is improved.

When the piston valve 6 ascends, the needle valve 28 also ascends, and since the needle valve 28 has the tapered outer shape, the circumferential gap between the needle valve 28 and the needle jet 25 increases in accordance with the ascending of the needle valve 28 and the fuel 21 within the float chamber 4 is hence sucked into the venturi passage 5 via this gap. The fuel 21 which has been sucked out is dispersed as a mist and becomes an air-fuel mixture. The air-fuel mixture is then sucked into the engine and the engine revolution is increased.

In this way, the passage area of the venturi passage 5 is automatically adjusted to supply the suitable quantity of fuel according to the opening degree of the throttle valve 7 by means of the piston valve 6. Furthermore the fuel of the quantity corresponding to this passage area is provided to the inside of the venturi passage 5, the air-fuel mixture of an optimum air-fuel ratio is constantly supplied to the engine side.

Concerning the vacuum response type carburetor 1, the diaphragm 12 of the diaphragm device 3 is formed of hydrogen impregnated NBR as mentioned hereinbefore. The following Table 1 is a comparison of the properties of hydrogen impregnated NBR as compared with those of hydrine rubber and NBR used to form the diaphragm in conventional vacuum response type carburetors.

TABLE 1

| | Hydrine Rubber | NBR | Hydrogen Impregnated NBR |
|---|---|---|---|
| Tensile strength [kg/cm$^2$] | 130 | 160 | 270 |
| Elongation Ratio [%] | 300 | 600 | 600 |
| Swelling Ratio [%] | 30 | 20 | 20 |
| Durability [10000 time operation] | 9 | 25 | 50 |

As can be seen from this table, the tensile strength of the hydrogen impregnated NBR was 70 to 100% greater than that of the hydrine rubber or NBR, and the elongation ratio thereof was far better than that of the hydrine rubber, as well. When swelling testing was conducted using a poor quality gasoline, the hydrogen impregnated NBR showed approximately 10% less swelling than the swelling of the hydrine rubber.

Further, when the poor quality gasoline was used to test the durability of the diaphragm, the diaphragm formed of the hydrogen impregnated NBR according to the present invention recorded 500,000 times durability deformations, far exceeding the 90,000 times of the hydrine rubber and the 250,000 times of the NBR, which are utilized in the conventional structure.

As can be understood from the above description, a diaphragm formed of hydrogen impregnated NBR provides a high chemical resistance and is hardly deteriorated even during use of a poor quality gasoline, so that problems such as early rupturing of the diaphragm or hardening thereof can be effectively avoided. Substantially the same result was obtained in a case of the high-octane gasoline and alcohol fuel, thus providing the improved durability. Similar results were also obtained by a diaphragm formed of a fluoro rubber.

Figure 3:
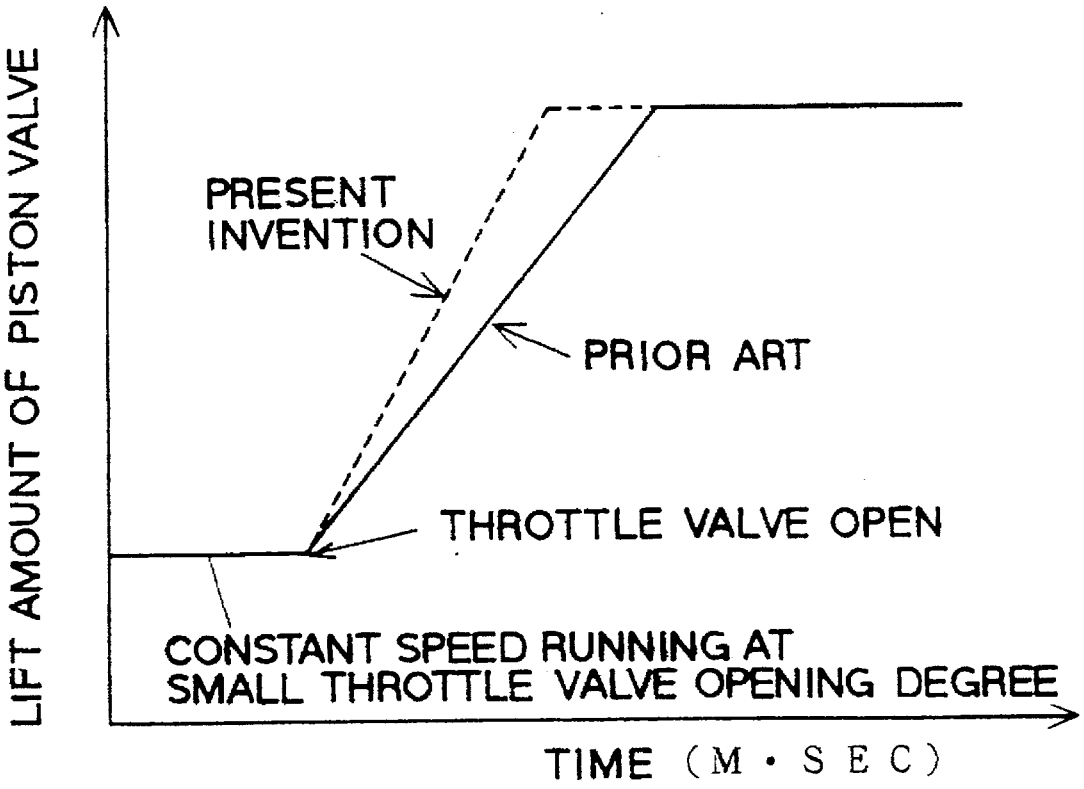
FIG. 3 is a graph showing a relationship of an ascending acceleration of the piston valve after the throttle valve has been opened with respect to elapsed time.

Moreover, since the hydrogen impregnated NBR or fluoro rubber has higher tensile strength, if it is required to obtain the same tensile strength as that of conventional material, the film thickness of the diaphragm can be made thinner than the case of the conventional material. If the film thickness of the diaphragm is made thinner, the rigidity is lowered and the flexibility is increased, so that the friction of the piston valve 6 during the movement thereof is decreased. Furthermore as shown in FIG. 3, the ascending speed of the piston valve following the opening of the throttle valve 7 is increased, that is, the amount of ascending of the piston valve 6 is increased per unit of time. Therefore, the throttle response can be remarkably improved.

Furthermore, this vacuum response type carburetor 1 is equipped with the seal members such as the gasket 30 and the O-rings 31, 32, 33, etc. formed of the hydrogen impregnated NBR or fluoro rubber, so that deterioration of these seal members 30, 31, 32 and 33 caused by a gasoline of poor quality, high-octane gasoline or alcohol fuel, etc., can be effectively avoided, thereby effectively preventing fuel leakage and improper settings.

Moreover, the hydrogen impregnated NBR or fluoro rubber may be used not only for the diaphragm 12 and the seal members 30 to 33, but also for other members which are susceptible to adhesion of fuel, such as the oil seals of the crankshaft of a two-stroke-cycle engine or an engine intake pipe for preventing the deterioration from fuel, thus maintaining the initial performance for a long time.

What is claimed is:

1. In a motorcycle vacuum response type carburetor including a carburetor body having an upper portion, a lower portion, a diaphragm device disposed at the upper portion and having a diaphragm chamber and a diaphragm separating the diaphragm chamber into an upper section and a lower section, a float chamber disposed at the lower portion, a venturi passage extending horizontally through the carburetor body, a guide passage extending through the venturi passage in a vertical direction thereof, the guide passage having an upper end portion in communication with the lower section of the diaphragm chamber, a piston valve movably disposed in the guide passage, the piston valve having a bore and a head portion fixed to a central portion of the diaphragm, and a needle valve for adjusting a jetting amount of a fuel and having an upper portion extending into the bore of the piston valve and a lower portion extending into the float chamber: a first communication passage for communicating the lower section of the diaphragm chamber to the atmosphere; and a second communication passage extending through the piston valve for communicating the upper section of the diaphragm chamber to the venturi passage, the second communication passage having an opening at a lower end thereof which opens from a lower end portion of the piston valve and which is in close proximity to the needle valve and having an opening at an upper end thereof which opens into the upper section of the diaphragm chamber but does not open into the bore of the piston valve; wherein the diaphragm is comprised of hydrogen impregnated nitrile butadiene rubber; and wherein the diaphragm is substantially circular in shape and has an inner peripheral portion, the head portion of the piston valve is connected to the inner peripheral portion of the diaphragm in a liquid-tight manner, the head portion of the piston valve has a recessed portion, and an upper end of the second communication passage opens into the recessed portion.

2. A motorcycle vacuum response type carburetor according to claim 1; wherein the lower end opening of the second communication communicating passage is proximate an upper end of the needle valve.

3. A motorcycle vacuum response type carburetor according to claim 1; wherein the head portion of the piston valve has upper and lower flange portions disposed around the recessed portion, the upper flange portion having a greater diameter than a diameter of the lower flange portion; and wherein the inner peripheral portion of the diaphragm is disposed between the upper and lower flange portions of the piston valve in a liquid-tight manner.

4. A motorcycle vacuum response type carburetor according to claim 1; wherein the piston valve has an upper end portion extending into the recessed portion.

5. A vacuum response type carburetor comprising: a body having first and second ends; a diaphragm chamber disposed at the first end of the body; a diaphragm member separating the diaphragm chamber into first and second sections; a first communication passage communicating the second section of the diaphragm chamber to the atmosphere; a venturi passage extending through the body between the first and second ends thereof; a second communication passage communicating the first section of the diaphragm chamber to the venturi passage; a float chamber disposed at the second end of the body; a guide passage extending through the venturi passage and having an end portion in communication with the second section of the diaphragm chamber; a piston valve movably disposed in the guide passage and having a bore and a first end portion connected to the diaphragm member, the second communication passage extending through the piston valve and having an opening at a first end thereof which opens from the first end portion of the piston valve into the first section of the diaphragm chamber; and a needle valve for adjusting a jetting amount of a fuel, the needle valve having a first end extending into the bore of the piston valve and a second end extending into the float chamber, the second communication passage having an opening at a second end thereof which opens into the first section of the diaphragm chamber but does not open into the bore of the piston valve.

6. A vacuum response type carburetor according to claim 5; wherein the diaphragm member is comprised of hydrogen impregnated nitrile butadiene rubber.

7. A vacuum response type carburetor according to claim 5; further comprising a casing member surrounding the float chamber, and a seal member of hydrogen impregnated nitrile butadiene rubber disposed between the body and the casing for providing a liquid-tight seal therebetween.

8. A vacuum response type carburetor according to claim 5; wherein the head portion of the piston valve has upper and lower flange portions disposed around the recessed portion, the upper flange portion having a greater diameter than a diameter of the lower flange portion; and wherein the diaphragm has an inner peripheral portion disposed between the upper and lower flange portions of the piston valve in a liquid-tight manner.

9. A vacuum response type carburetor according to claim 5; wherein the second communication passage has an opening at a second end thereof which opens from the second end portion of the piston valve and which is in close proximity to the needle valve.

10. A vacuum response type carburetor according to claim 9; wherein the opening at the second end of the second communication passage is proximate the first end of the needle valve.

11. A vacuum response type carburetor comprising: a body having first and second ends; a diaphragm chamber disposed at the first end of the body; a diaphragm member separating the diaphragm chamber into first and second sections; a first communication passage communicating the second section of the diaphragm chamber to the atmosphere; a venturi passage extending through the body between the first and second ends thereof; a second communication passage communicating the first section of the diaphragm chamber to the venturi passage; a float chamber disposed at the second end of the body; a guide passage extending through the venturi passage and having an end portion in communication with the second section of the diaphragm chamber; a piston valve movably disposed in the guide passage and having a bore and a first end portion connected to the diaphragm member, the first end portion of the piston valve having a recessed portion, and the second communication passage extending through the piston valve and opening into the recessed portion of the piston valve but not opening into the bore of the piston valve; and a needle valve for adjusting a jetting amount of a fuel, the needle valve having a first end extending into the bore of the piston valve and a second end extending into the float chamber.

12. A vacuum response type carburetor according to claim 11; wherein the head portion of the piston valve has upper and lower flange portions disposed around the recessed portion, the upper flange portion having a greater diameter than a diameter of the lower flange portion; and wherein the diaphragm has an inner peripheral portion disposed between the upper and lower flange portions of the piston valve in a liquid-tight manner.

13. A vacuum response type carburetor comprising: a body having first and second ends; a diaphragm chamber disposed at the first end of the body; a diaphragm member separating the diaphragm chamber into first and second sections; a first communication passage communicating the second section of the diaphragm chamber to the atmosphere; a venturi passage extending through the body between the first and second ends thereof; a second communication passage communicating the first section of the diaphragm chamber to the venturi passage; a float chamber disposed at the second end of the body; a guide passage extending through the venturi passage and having an end portion in communication with the second section of the diaphragm chamber; a piston valve movably disposed in the guide passage and having a bore and a first end portion connected to the diaphragm member, the diaphragm member being substantially circular in shape and having an inner peripheral portion, the first end portion of the piston valve being connected to the inner peripheral portion of the diaphragm member in a liquid-tight manner, the first end portion of the piston valve having a recessed portion, and the second communication passage opening into the recessed portion of the piston valve but not opening into the bore of the piston valve; and a needle valve for adjusting a jetting amount of a fuel, the needle valve having a first end extending into the bore of the piston valve and a second end extending into the float chamber.

14. A vacuum response type carburetor according to claim 13; wherein the head portion of the piston valve has upper and lower flange portions disposed around the recessed portion, the upper flange portion having a greater diameter than a diameter of the lower flange portion; and wherein the diaphragm has an inner peripheral portion disposed between the upper and lower flange portions of the piston valve in a liquid-tight manner.

15. A vacuum response type carburetor comprising:

a carburetor main unit having an upper portion and a lower portion;

a diaphragm device disposed at the upper portion of the carburetor main unit and having a diaphragm chamber;

a diaphragm comprised of hydrogen impregnated nitrile butadiene rubber and separating the diaphragm chamber into an upper section and a lower section, the diaphragm being substantially circular in shape and having an inner peripheral portion;

a float chamber disposed at the lower portion of the carburetor main unit;

a venturi passage extending horizontally through the carburetor main unit;

a guide passage extending through the venturi passage in a vertical direction thereof and having an upper end portion in communication with the lower section of the diaphragm chamber;

a piston valve movably disposed in the guide passage and having a head portion fixed to a central portion of the diaphragm, the head portion having a recessed portion and upper and lower flange portions disposed around the recessed portion, the upper flange portion having a greater diameter than a diameter of the lower flange portion, the inner peripheral portion of the diaphragm being disposed between the upper and lower flange portions of the piston valve in a liquid-tight manner;

a needle valve mounted to a lower portion of the piston valve and extending into the float chamber for adjusting a jetting amount of a fuel;

a first communication passage for communicating the lower section of the diaphragm chamber to the atmosphere; and a second communication passage extending through the piston valve for communicating the upper section of the diaphragm chamber to the venturi passage, the second communication passage having an opening at each of an upper end and a lower end thereof, the opening at the lower end being in close proximity to an upper end of the needle valve, and the opening at the upper end opening into the recessed portion of the piston valve.

16. A vacuum response type carburetor according to claim 15; wherein the piston valve has a bore; and wherein the opening at the upper end of the second communication passage does not open into the bore of the piston valve.

17. A vacuum response type carburetor according to claim 15; wherein the piston valve has an upper end portion extending into the recessed portion.

* * * * *